United States Patent [19]

Kasel et al.

[11] 4,042,168

[45] Aug. 16, 1977

[54] PACKAGING CONTAINER BLANK

[75] Inventors: Richard G. Kasel, South St. Paul, Minn.; Paul C. Brown, Hudson, Wis.

[73] Assignee: Minnesota Mining and Manufacturing Company, St. Paul, Minn.

[21] Appl. No.: 719,288

[22] Filed: Aug. 31, 1976

[51] Int. Cl.[2] ..... B65D 5/06; B65D 85/671

[52] U.S. Cl. ..... 229/40; 229/48 T; 206/396; 206/411; 206/631

[58] Field of Search ..... 229/40, DIG. 11, 51 WB, 229/37 R, 48 T; 206/394–396, 389, 411, 412, 819

[56] References Cited

U.S. PATENT DOCUMENTS

| | | | |
|---|---|---|---|
| 1,975,253 | 10/1934 | Connolly | 206/819 X |
| 2,141,752 | 12/1938 | Hoarle | 206/819 X |
| 2,353,311 | 7/1944 | Karlson | 229/48 T |
| 2,708,066 | 5/1955 | Caraher | 229/40 |
| 2,765,579 | 10/1956 | Gordon | 229/40 X |
| 2,781,159 | 2/1957 | Copeman | 229/51 WB |
| 2,812,727 | 11/1957 | Dorsey | 206/391 X |
| 2,985,545 | 5/1961 | Leavitt | 229/51 WB |
| 3,495,757 | 2/1970 | Pascus et al. | 229/40 X |
| 3,791,571 | 2/1974 | Pilz | 229/40 |
| 3,855,052 | 12/1974 | Mestetsky | 206/411 X |

FOREIGN PATENT DOCUMENTS

| | | | |
|---|---|---|---|
| 2,434,741 | 10/1975 | Germany | 206/396 |
| 266,654 | 8/1929 | Italy | 206/395 |
| 764,666 | 12/1956 | United Kingdom | 206/396 |

*Primary Examiner*—Robert S. Ward, Jr.
*Attorney, Agent, or Firm*—Cruzan Alexander; Donald M. Sell; James V. Lilly

[57] ABSTRACT

A packaging container blank comprising a rectangular central section including at least one tab therein which is hinged on one edge to the central section, the remaining edges of said tab being severed from said central section. Two outer panels are attached to opposite peripheral edges of the central section, and two flange panels are attached to the other opposite edges of the central section. The blank is adapted to be folded into the form of a container.

9 Claims, 4 Drawing Figures

PACKAGING CONTAINER BLANK

BACKGROUND OF THE INVENTION

This invention relates to packaging container blanks. More particularly it relates to one-piece (i.e., integral) packaging container blanks which are particularly suited for holding products wound around a central core (sometimes referred to hereinafter as roll goods). Such blanks may also be referred to as one-piece folder blanks.

Packaging container blanks as such have been used previously. In general they comprise a section of material (e.g., corrugated paperboard) which may be folded so as to form the top, bottom and sides of a completed container. In the simplest sense only two sides of the package are formed when a previously known blank is folded, the remaining sides being open. Conatainers or packages formed from this type of blank are less sturdy than those wherein all four sides of the container are closed. Additionally, these container blanks, whether providing two or four closed sides when folded, require that some additional means or techniques be employed when centering roll goods on the blank prior to forming the carton therearound. This requirement for additional centering means, of course, reduces the efficiency and adds to the cost of any packaging operation employing such cartons.

Various attempts have been made to strengthen the completed carton while improving the efficiency of the packaging operation at the same time. Thus, for example, centering means which rise from the plane of the blank and are permanently affixed thereto have been previously proposed. However, this approach has not proven entirely satisfactory because the raised centering or positioning means increases the height of the blank, thereby requiring the use of additional space when a plurality of such blanks are stored. Morever, the raised positioning means makes it difficult to provide a stable stack of such blanks.

Other previously used container blanks employ core-locking tabs which fit inside the core of roll goods to be packaged. Such tabs are typically provided as extensions of the closure flaps of the blank. As such they provide no means for easily and accurately locating the roll goods on the blank prior to forming the carton. Additionally they tend to slide toward each other after they have been inserted into the center area of the core, thereby necessitating a locking insert to be placed between them to hold such tabs securely after the package has been made. This reduces the efficiency and increases the cost of the packaging operation. It also adds to the cost of the formed container.

These and other disadvantages of the prior art are overcome by packaging container blanks of the present invention. Such blanks comprise a flat, one-piece construction. Thus, the novel blanks require relatively little storage space per unit and may be easily collected in stable stacks in their unfolded state. Additionally, blanks of the invention may be easily formed into crush-resistant cartons. Moreover, they provide means for quickly and accurately centering roll goods thereon prior to forming the carton.

Containers made from blanks of the invention can be used to package a variety of materials. Representative of these materials are tapes (e.g., masking, cellophane, adhesive, etc.), film adhesives, decorative ribbons, windshield sealers, etc.

SUMMARY OF THE INVENTION

In accordance with the present invention there is provided a packaging container blank comprising a rectangular central section, two outer panels attached to opposite edges of said central section and two flange panels attached to the other opposite edges of said central section;

wherein said central section includes at least one tab hinged on one edge thereof to said central section and lying in the plane of said central section, the remaining edges of said tab being severed from said central section, said tab being adapted to be disposed normal to the plane of said central section at a predetermined height;

wherein each of said outer panels and said flange panels are foldable along the edges of said central section and are further foldable along predetermined lines parallel to the edges of said central section; and wherein each of said outer and flange panels are adapted to form right angles at the edges of said central section and at said predetermined lines when folded, and wherein the portions of said outer panels and of said flange panels between the edges of said central section and said predetermined lines form the sides of said packaging container upon folding; and wherein a portion of said flange panels are adapted to extend over said folded outer panels.

BRIEF DESCRIPTION OF THE DRAWINGS

The invention is described in more detail hereinafter with reference to the accompanying drawings wherein like reference characters refer to the same parts throughout the several views and in which.

DETAILED DESCRIPTION OF THE INVENTION

Figure 1:
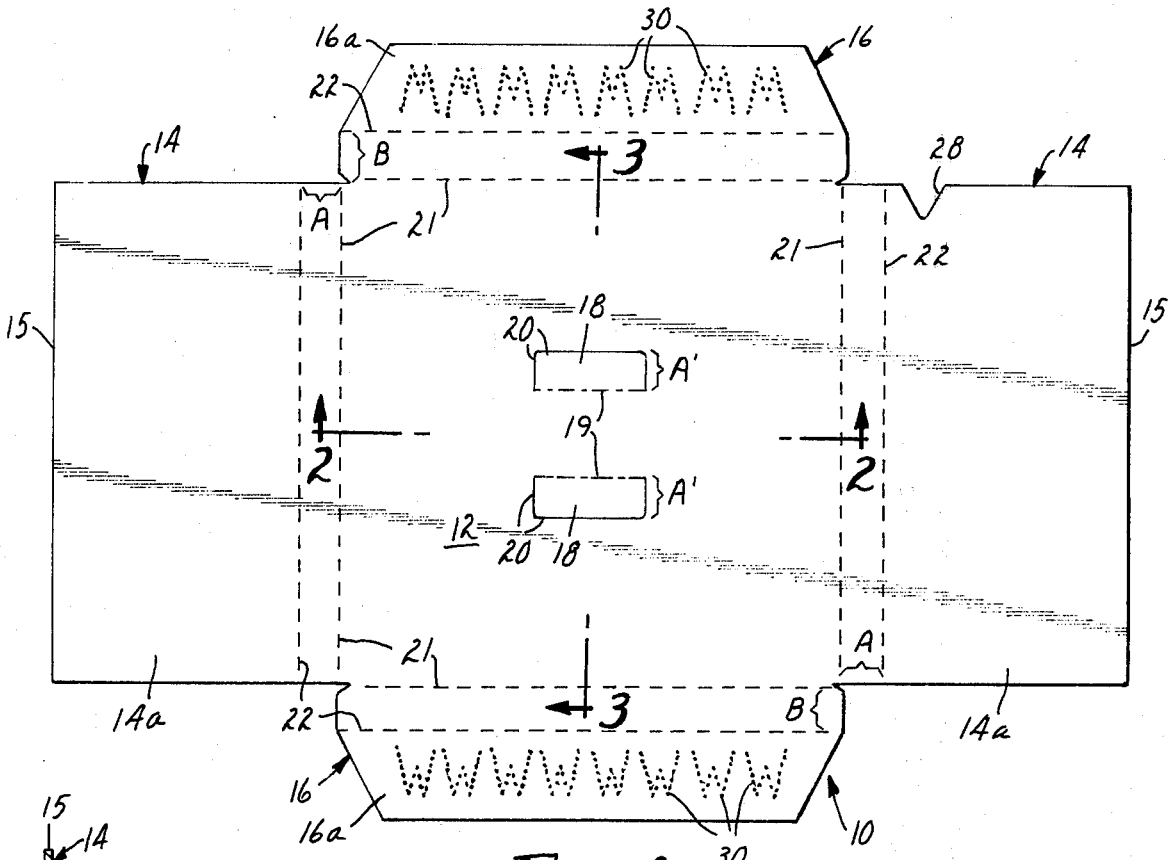
FIG. 1 is a plan view of a preferred embodiment of a packaging container blank according to the present invention.

Referring now to FIG. 1, there is shown a preferred embodiment of a blank 10 for a packaging container comprising a rectangular central section 12, two outer panels 14 attached to opposite edges of central section 12 and two flange panels 16 attached to the other opposite edges of central section 12.

Situated within the plane of central section 12 are two tabs 18 which are hingeably fixed to said section along one of their edges at lines 19. The remaining edges of tabs 18 are severed from central section 12 along lines 20.

Figure 2:
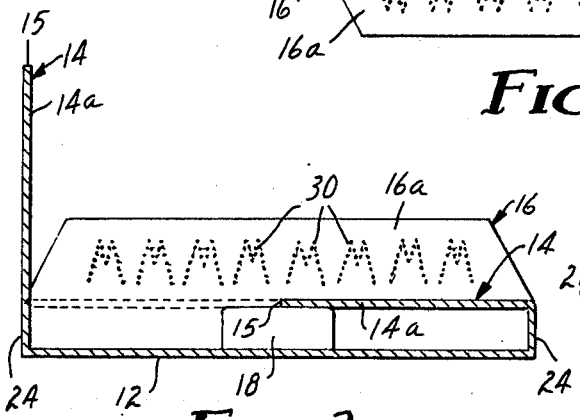
FIG. 2 is a sectional view of a partially formed container made from the blank of FIG. 1, said view being along the line 2—2 of FIG. 1.
Figure 3:
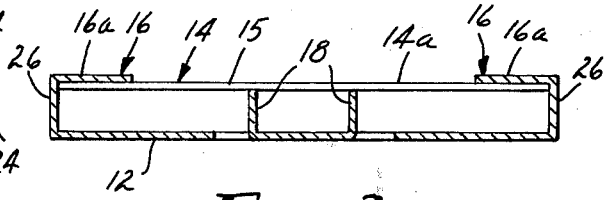
FIG. 3 is a sectional view of a completely formed container made from the blank of FIG. 1, said view being along the line 3—3 of FIG. 1.
Figure 4:
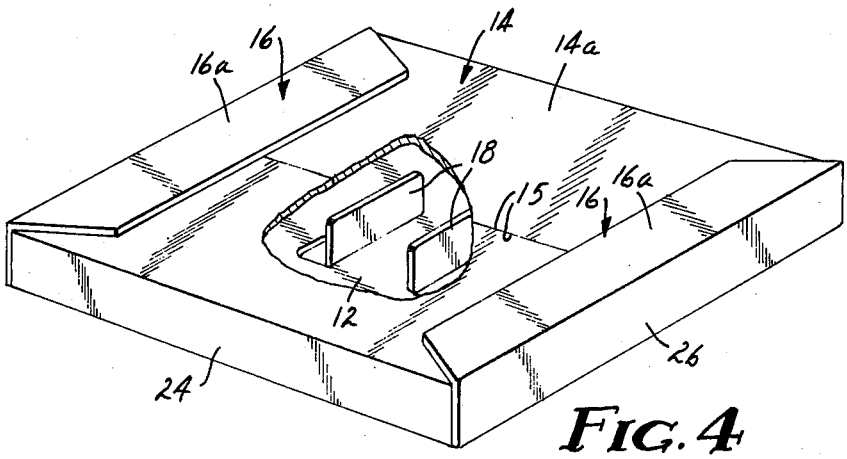
FIG. 4 is a perspective, partial cut-away view of a completely formed container made from the blank of FIG. 1.

Tabs 18 are adapted to fold at lines 19 so as to project normal to the plane of central section 12. The foldability of the tabs may be facilitated by scoring or creasing central section 12 along lines 19. Preferably tabs 18 are adaptable to project a predetermined distance A′ equal to the interior height of the desired formed container so that portions **14*a* of outer panels 14, in folded form, rest on tabs 18 as shown in FIGS. 2, 3 and 4. In this configuration tabs 18 provide added structural strength to the formed container and, additionally, provide means by which roll goods may be quickly and accurately aligned on blank 10** prior to forming the completed container. Moreover, they prevent lateral movement of the goods positioned thereon. Consequently, the risk of damage to the roll goods during handling and storage of the completed package is minimized.

While the embodiment set forth in the figures illustrates the use of two tabs, the use of one or more than two is also possible and such use is included within the scope of the invention.

Outer panels 14 and flange panels 16 are foldably attached to the edges of central section at lines 21. Panels 14 and 16 are also foldable along lines 22, which lines are parallel to the edges of central section 12. The foldability of panels 14 and 16 may be improved by scoring or creasing said panels along lines 21 and 22.

Outer panels 14 are adapted so that when folded they may form right angles at lines 21 and 22. It is preferred that edges 15 of the panels abut each other after folding of the panels. When in this configuration, the portion of the panels 14 between lines 21 and 22 defines two opposite sides 24 of the formed carton. Distance A is preferably equal to the distance A' of tabs 18 so that, as discussed above, portions **14*a* of panels 14 may rest upon tabs 18** the in formed carton.

Flange panels 16 are adapted so that, when folded, they also may form right angles at lines 21 and 22. Additionally, portions **16*a* of said flange panels extend over portions 14*a* of the folded outer panels 14 forming flaps thereon as is shown in FIGS. 3 and 4. When so folded, the portions of the flange panels 16 between lines 21 and 22 define the remaining opposite sides 26 of the carton. Distance B is preferably equal to the distance between lines 21 and 22 on panels 14 plus the thickness of one of panels 14.**

In a particularly preferred embodiment of the present invention, the width of panels 16 at lines 21 is slightly less than the width of central section 12. However, panels 16 quickly widen out from lines 21 as shown in FIG. 1 so that they are slightly wider than central section 12. This enables panels 16 to substantially completely close the side corners of the formed carton. Additionally, it is preferred that the outer corners of panels 16 be removed as shown in the drawings.

While the embodiment set forth in FIGS. 3 and 4 shows that panels 16 are smaller than panels 14, larger panels are intended to be included within the scope of the present invention.

A number of additional features may be incorporated into the packaging container blank of the invention, if desired. For example, the surface of the blank which is to serve as the interior of the formed carton may have a continous release coating thereon so as to prevent the contents of the carton from sticking to the insides of the carton. Such release coatings are well known and include, for example, silicone-based compositions such as "Sly-Off", commercially available from Dow Corning, and "Bay-cote 470", commercially available from Green Bay Packaging Inc.

Other features that may be included in the blank of the present invention, if desired, are shown in FIG. 1 and include (i) an indexing means 28 comprising, for example, a notch in the edge of the panel 14 for uniformly and accurately positioning a plurality of blanks 10 and (ii) perforations 30 for improving adhesion between panels 14 and 16 when an adhesive is applied therebetween.

As shown in FIG. 1, indexing means 28 is located in one of panels 14 and comprises a triangular notch in the edge of that panel. The location and shape of indexing means 28 is not critical to the present invention, and, accordingly, it may instead be located in any of the other panels and may have any of a variety of useful shapes.

The perforations shown in FIG. 1 comprise a plurality of regularly occurring punctures in panels 16. Preferably they extend into panels 16 without going completely through such panels. While the perforations may be arranged in a variety of configurations, that shown in FIG. 1 is preferred.

Blank 10 may be constructed from any of a variety of known materials. Representative of such materials are corrugated paperboard, chipboard, fiberboard, corrugated polyethylene, expanded polystyrene, etc. A preferred material is corrugated paperboard.

Blank 10 may be manufactured by a variety of techniques. A particularly useful technique comprises diecutting the blank from a large sheet of the material of construction.

The packaging container blank described in the Figures is but one embodiment of the invention. Other embodiments are also possible, as will be understood by those skilled in the art, and are all included within the scope of the following claims.

What is claimed is:

1. A packaging container blank comprising a rectangular central section, two outer panels attached to opposite edges of said central section and two flange panels attached to the other opposite edges of said central section;

wherein said central section includes at least one tab hinged on one edge thereof to said central section and lying in the plane of said central section, the remaining edges of said tab being severed from said central section, said tab being adapted to be disposed normal to the plane of said central section at a distance equal to the interior height of the formed container;

wherein each of said outer panels and said flange panels are foldable along the edges of said central section and are further foldable along predetermined lines parallel to the edges of said central section; and wherein each of said outer and flange panels are adapted to form right angles at the edges of said central section and at said predetermined lines when folded, and wherein the portions of said outer panels and of said flange panels between the edges of said central section and said predetermined lines form the sides of said packaging container upon folding; and wherein a portion of said flange panels are adapted to extend over said folded outer panels.

2. A packaging container blank according to claim 1 wherein said central section is square.

3. A packaging container blank according to claim 1 wherein said central section contains two tabs disposed parallel to each other.

4. A packaging container blank according to claim 1 wherein said outer panels and said flange panels are scored on one major surface thereof along said edges of said central section and along said predetermined lines.

5. A packaging container blank according to claim 4 wherein there is a continuous release coating on the entire said major surface.

6. A packaging container blank according to claim 5 wherein the surface of that portion of said flange panels which is adapted to extend over said folded outer panels has a plurality of perforations therein.

7. A packaging container blank according to claim 6 wherein one of said outer panels contains an indexing means.

8. A packaging container blank according to claim 1 wherein said outer panels are adapted to abut each other when folded.

9. A packaging container blank according to claim 6 wherein one of said inner panels contains an indexing means.

* * * * *